US005511756A

United States Patent [19]

Spradling

[11] Patent Number: 5,511,756

[45] Date of Patent: Apr. 30, 1996

[54] BALL GLOVE HOLDING AND MANAGING DEVICE

[76] Inventor: Ronald E. Spradling, 301 E. Boardwalk Dr., Ft. Collins, Colo. 80525

[21] Appl. No.: 209,783

[22] Filed: Mar. 11, 1994

[51] Int. Cl.[6] ..... A23B 71/00

[52] U.S. Cl. ..... 248/316.7; 24/306; 248/317

[58] Field of Search ..... 248/205.2, 231, 248/231.9, 316.7, 317; 24/306, 301, 302, 555, 545

[56] References Cited

U.S. PATENT DOCUMENTS

| | | | |
|---|---|---|---|
| 20,364 | 5/1858 | Pierce | 24/545 |
| 365,389 | 6/1887 | Koegel | 248/317 X |
| 1,064,952 | 6/1913 | Allen | 248/317 X |
| 1,782,057 | 11/1930 | Bollinger | 24/301 |
| 3,022,898 | 2/1962 | Loeb | 248/231 X |
| 3,193,235 | 7/1965 | Jensen | 248/317 |
| 3,638,284 | 2/1972 | Baker | 24/306 |
| 4,417,710 | 11/1983 | Adair | 248/205.2 X |
| 4,639,980 | 2/1987 | Peterson | 24/306 |
| 4,759,963 | 7/1988 | Uso, Jr. et al. | 248/205.2 X |
| 4,878,585 | 11/1989 | Orestano | 248/205.2 X |
| 4,984,725 | 1/1991 | Urbom | 248/205.2 X |
| 4,989,811 | 2/1991 | Millis et al. | 248/205.2 X |
| 5,104,076 | 4/1992 | Goodall, Jr. | 248/205.2 |
| 5,174,481 | 12/1992 | LeDune | 224/901 X |

FOREIGN PATENT DOCUMENTS

| | | | |
|---|---|---|---|
| 1093526 | 11/1960 | Germany | 248/317 |

*Primary Examiner*—Alvin C. Chin-Shue
*Assistant Examiner*—Derek J. Berger

[57] ABSTRACT

A body of materials assembled in such a way so as to provide a means of holding or suspending the device itself, and a ball mitt or glove, from a separate structure such as the fence of a dugout or ball diamond. This is achieved with the use of a strap 12, or adjustable strap 100, 102. The device has the capacity to hold a ball glove by a gripping appendage, the clip 60. The clip 60 holds the ball glove while the glove is not in use during a ball game such as during at-bats or while stored. Additionally, the device provides a means of holding a small personal item, such as a set of keys (key strap 30), simultaneously with the ball mitt or glove during a ball game. An optional secondary use allows one to store the ball mitt or glove with a ball in the pocket and hold the ball there with the use of the adjustable strap 100 or 102. This provides a way to maintain the most desirable shape of the ball mitt or glove. The strap 100 or 102 may also be used to encompass the handle of a ball bat as well as a pair of batting gloves tucked into the ball mitt pocket with the ball, or any other small accessory.

1 Claim, 9 Drawing Sheets

BALL GLOVE HOLDING AND MANAGING DEVICE

BACKGROUND—FIELD OF INVENTION

This invention relates to both the use and storage of a baseball mitt or softball mitt, and optionally a ball, a bat, a pair of batting gloves, and a set of car keys and/or any item that is better left remote from the person while playing in a game of baseball or softball.

BACKGROUND—DESCRIPTION OF PRIOR ART

No relative prior art has been found at the time of this filing. Search is in progress.

OBJECTS AND ADVANTAGES

The ball glove holding device (Mitt Clip) or ball glove managing device (Mitt Manager), names used for reference in this document, demonstrates several objects and advantages. The objects and advantages of this invention are:

(a) to provide a means of caring for one's baseball or softball mitt, ball, and/or bat while not in use, (Mitt Manager);

(b) to provide a means of holding a ball mitt during the at-bat half of an inning, (Mitt Clip and Mitt Manager);

(c) to provide a means of holding a set of car keys or some other small item such as a ring or watch while playing ball, (Mitt Clip and Mitt Manager);

(d) to provide a means to remove the mitt from the clip without using both hands, (Mitt Clip and Mitt Manager);

(e) to provide a means of storing and maintaining the ball mitt in a desirable shape by using the Mitt Manager to hold a ball in the pocket by encompassing the mitt with the strap of the Mitt Manager;

(f) to provide a means that prevents the mitt from falling onto the ground while the player is in the dugout or at bat, (Mitt Clip and Mitt Manager);

(g) to provide a means that reduces the chance of a teammate mistakenly grabbing the wrong mitt and running out into the field with it, (Mitt Clip and Mitt Manager);

(h) to provide a means of identifying one's mitt from others in the dugout by virtue of the Mitt Clip or Mitt Manager's colors or other distinguishing characteristics, ie. a name tag;

(i) to provide a means of hanging the mitt out of the way from the crowded bench in the dugout which allows room for players on the bench, (Mitt Clip and Mitt Manager);

(j) to provide a means of preventing the mitt from being sat on and mashed into an undesirable shape were it placed on the bench, (Mitt Clip and Mitt Manager);

(k) to provide a small, light-weight and attractive way to manage one's ball mitt, (Mitt Clip and Mitt Manager);

(l) to provide a means of allowing a wide variety of material in a vast array of colors to be selected for manufacture, (Mitt Clip and Mitt Manager);

(m) to provide an inexpensive tool to care for and aid in the use of one's ball mitt and to manage the location of other equipment and accessories as mentioned above, (The Mitt Manager).

(n) to provide a means of training or breaking in one's new ball mitt or glove, (The Mitt Manager).

Additional objects and advantages may become apparent in the future, as well as applications in other areas of sport once the product becomes in use.

DRAWING FIGURES

REFERENCE NUMERALS IN DRAWINGS

12—The strap or cord of the Mitt Clip.
20—The body of the Mitt Clip.
22—The body of the Mitt Manager.
30—The key strap.
40—The Velcro hook and loop fasteners, both halves.
40A—The loop side of the Velcro hook and loop fastener used on the key strap.
40B—The hook side of the Velcro hook and loop fastener used on the key strap.
42A—The loop side of the Velcro hook and loop fastener used on the Mitt Manager strap (optional).
42B—The hook side of the Velcro hook and loop fastener used on the Mitt Manager strap (optional).
50—The key ring.
60—The clip in the shape of a bat.

70—The body assembly complete, on the Mitt Clip model.
72—The body assembly complete, on the Mitt Manager model.
80—Hole in the clip for attachment to key ring.
90—A specially shaped slit.
100—The strap of the Mitt Manager when used with the optional clip (fastex-type) assembly.
102—The strap of the Mitt Manager when used with the optional Velcro fasteners.
110—The female end of the optional (fastex-type) clip.
120—The male end of the optional (fastex-type) clip.

DESCRIPTIONS—FIGS. 1A–11

For the purpose of illustrating two models of the invention of the "Ball Glove Holding and Managing Device", the Mitt Clip and The Mitt Manager are documented below. However, the embodiments described, shown, and represented in this application are not intended to be all inclusive.

Figure 1A:
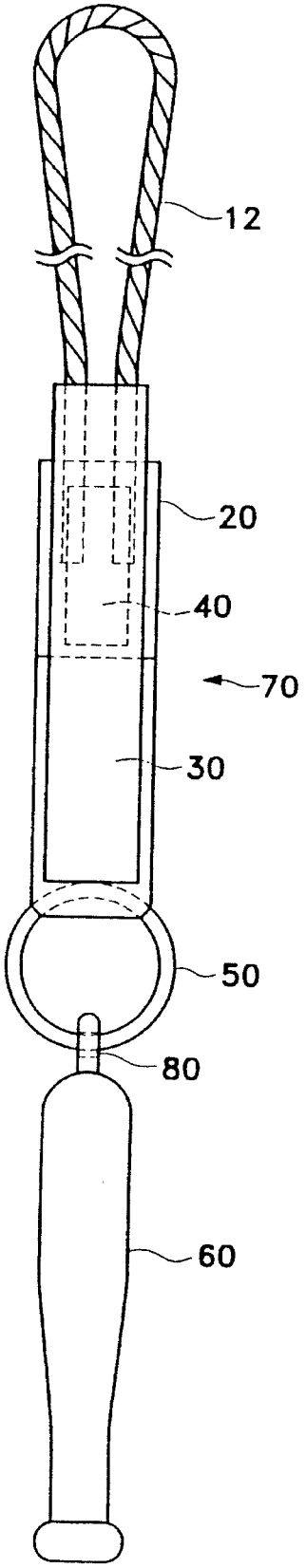
FIG. 1A shows the front view of the Mitt Clip model. Note strap/cord 12.
Figure 1B:
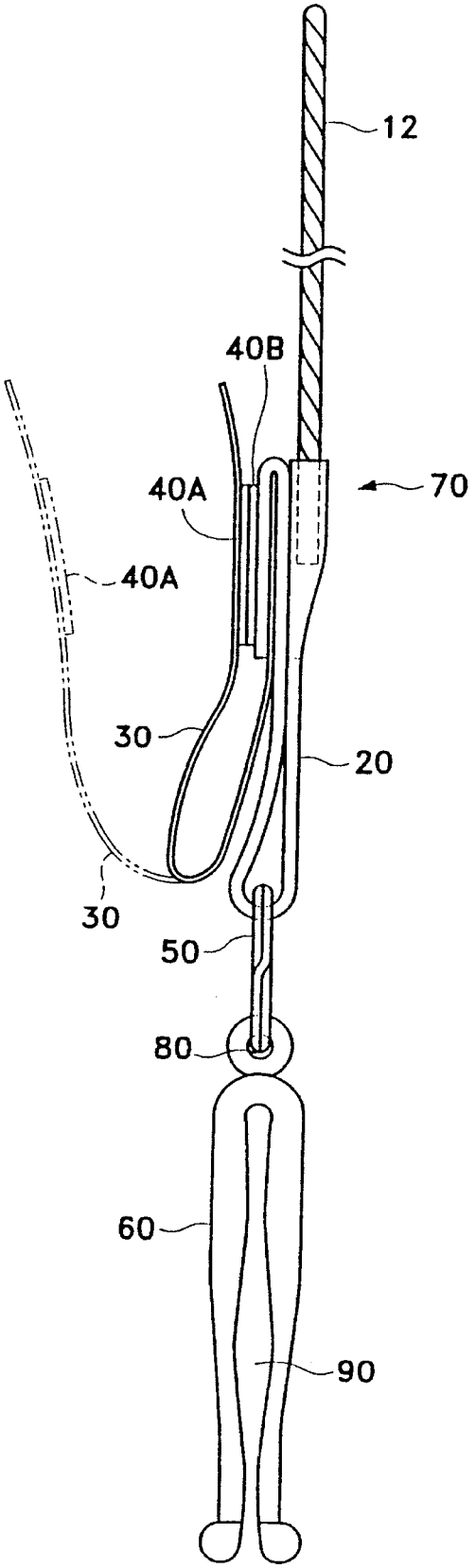
FIG. 1B shows the side view of the Mitt Clip model.
Figure 5:
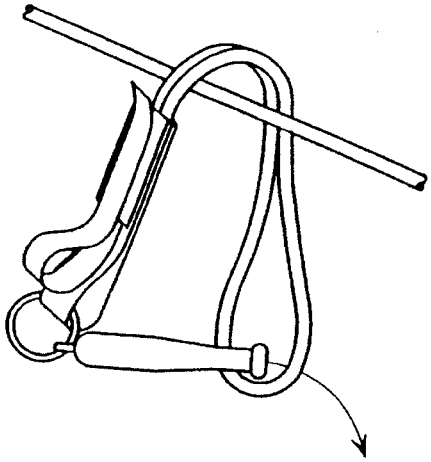
FIG. 5 shows how the strap or cord of the Mitt Clip is attached to a separate structure such as a chain-link fence.
Figure 6:
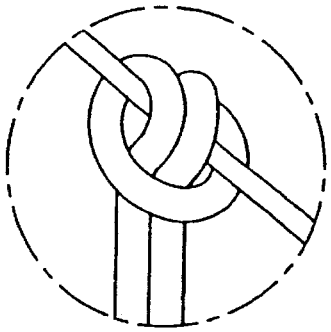
FIG. 6 shows the loop resulting from the Mitt Clip strap being looped around a portion of a chain-link fence.
Figure 4:
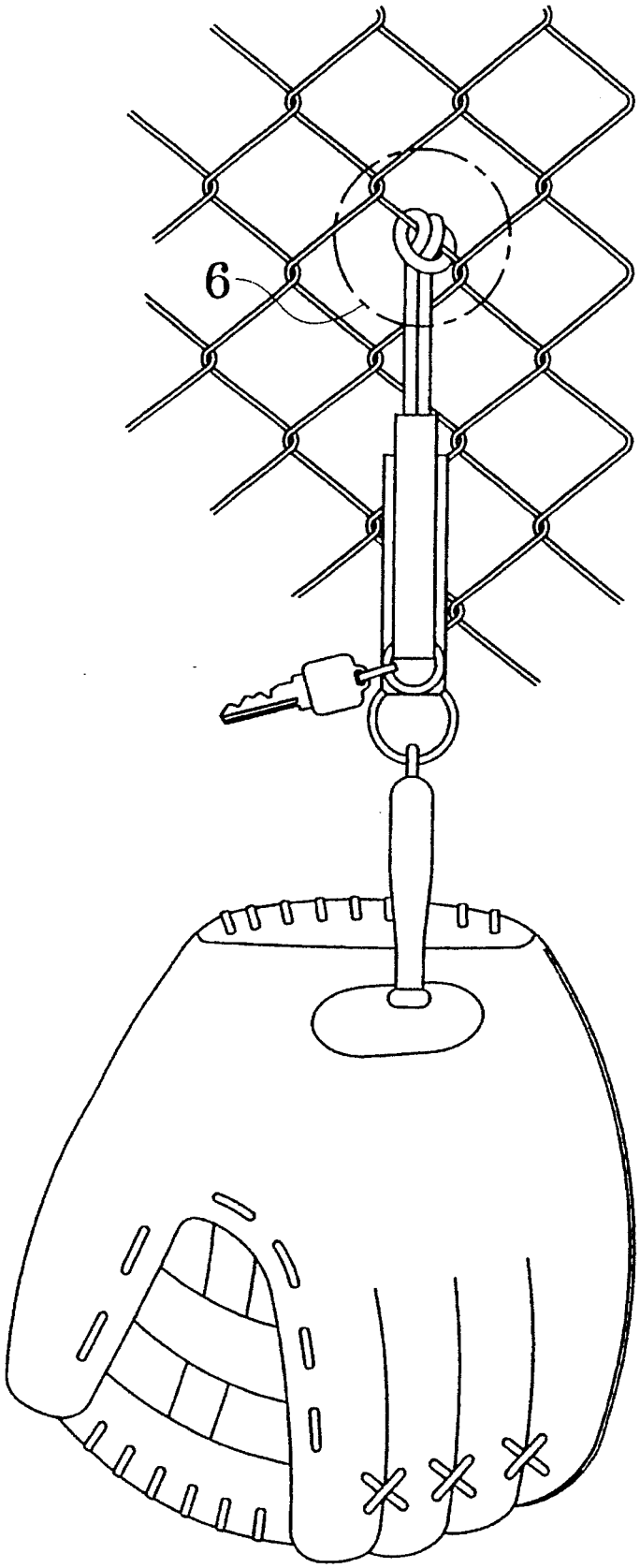
FIG. 4 shows the Mitt Clip in use and suspended from a chain link fence with a key on a ring held in the key strap and a ball mitt held by the Mitt Clip holding the wrist strap of the mitt.

A typical embodiment of the Mitt Clip model of the invention is illustrated in FIG. 1A (front view of the Mitt Clip) and FIG. 1B (side view of the Mitt Clip). The Mitt Clip has a strap or cord 12 which is made of any durable material of a flexible character. The material should be one that can be repeatedly looped around, and unlooped from any free standing structure such as a wire or chain-link fence as illustrated in FIGS. 4, 5, and 6, (Mitt clip in use) that is might be used around a ball diamond or dugout.

A flexible material of similar character is used to make the body 20 of the Mitt Clip. This piece 20 can be any dimension as long as it provides a large enough foundation for the other pieces to be attached to it. In the illustration, FIG. 1A (front view of Mitt Clip) and FIG. 1B (side view), the body 20 incorporates a piece of nylon webbing of a tubular type, so as to allow the strap or cord 12 folded in half, to be slid into the tube of webbing for its final assembly and leave a loop extending a few inches beyond the body 20 as shown in FIG. 1B (side view of Mitt Clip). FIG. 1B (side view of Mitt Clip) shows how the body 20 is folded to assemble its basic shape.

The key strap 30 is placed into the last fold of the body 20 before the body 20 and key strap 30 are assembled as illustrated in FIG. 1B (side view of Mitt Clip). The key ring 50 is one, but not the only, means of attachment for the clip 60 to be attached to the body assembly of the Mitt Clip 70 by sliding the spread key ring 50 through the hole 80 in the large end of the clip 60 for a completed product.

For novelty's sake, but not necessarily, the clip 60 is fashioned in a shape similar to that of a ball bat and the clip 60 can be constructed of any material that will support the clip's 60 function as described and illustrated.

The clip 60 (FIGS. 1A, 1B, 7A, and 7B) is designed and shaped in such a way so as to facilitate the clip 60 being placed over the wrist strap of a ball mitt, or for the wrist strap to be slid into the slit 90 with minimal, effort and held in a suspended fashion, until the player takes it. The slit 90 also allows the mitt to be pulled free or slid from the clip 60 with one hand, rapidly and without delay. This functions because the slit 90 is in line with and parallel to the axis of the hole 80 and has a shape that is sharply tapered at the open end, closes to a narrow width just in from the open end of the clip 60, then becomes wider again as the slit 90 approaches the mid-section of the clip 60. Near the larger end of the clip 60 the slit again narrows to approximately the same width as the area just in from the open end, as illustrated in FIG. 1B and 7B, where it terminates. This shape allows for some flexibility and yet provides a grip to hold the mitt in suspension, and allows the mitt's quick removal with a slight pull with one hand.

Figure 2:
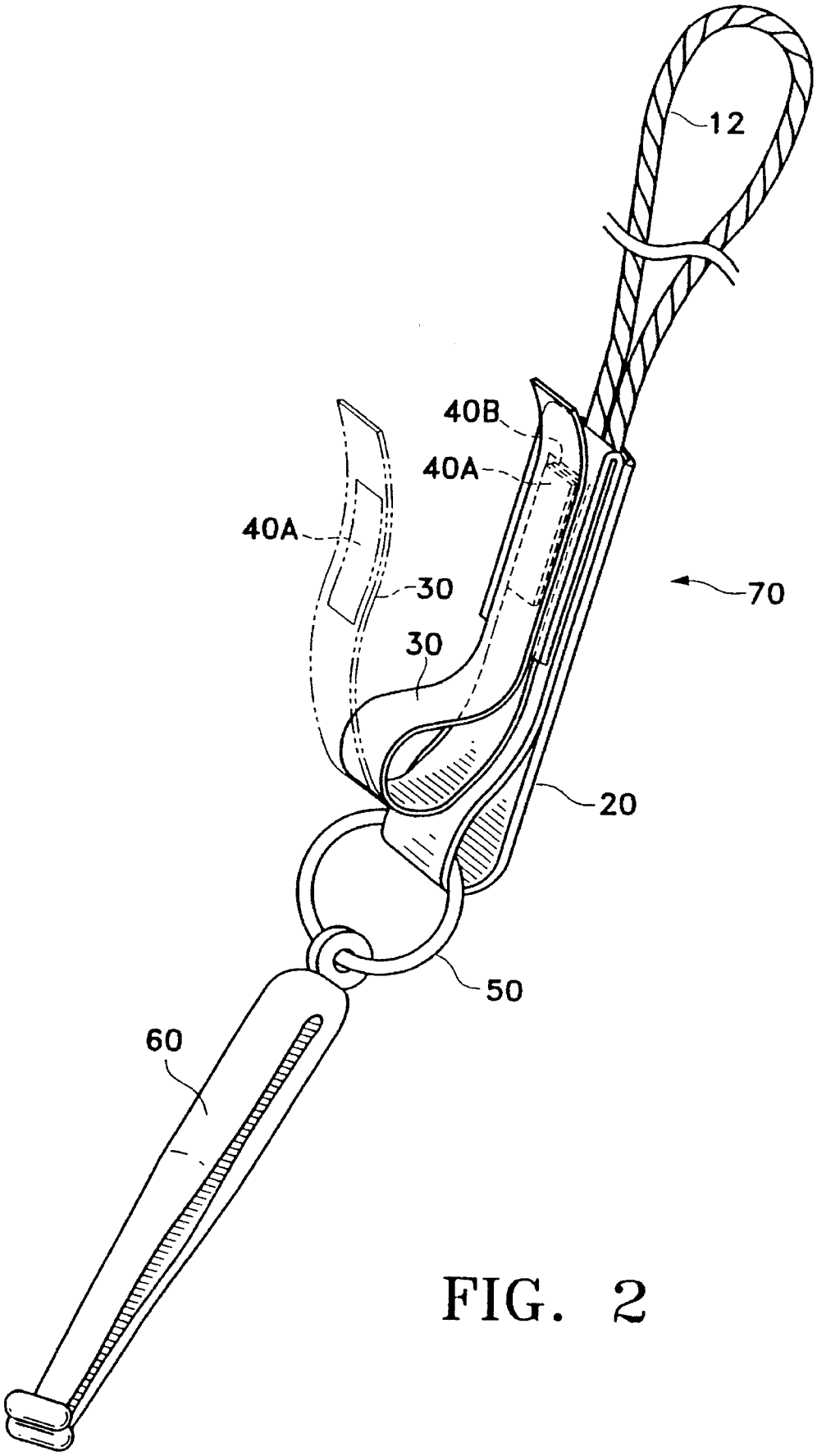
FIG. 2 shows a three-dimensional perspective of the Mitt Clip with the key strap outlined in the alternate open position.

A three dimensional view of the Mitt Clip is illustrated in FIG. 2 (Three-Dimensional view of Mitt Clip). The feature of the key strap 30 is illustrated in the closed position with the open position shown with phantom lines. The key strap 30 is made of any material that allows a key, set of keys, or any small item to be held temporarily by any means of attachment. The Velcro hook and loop fasteners 40A and 40B are used in this illustration to supply a means of attachment for the key strap 30.

Figure 3:
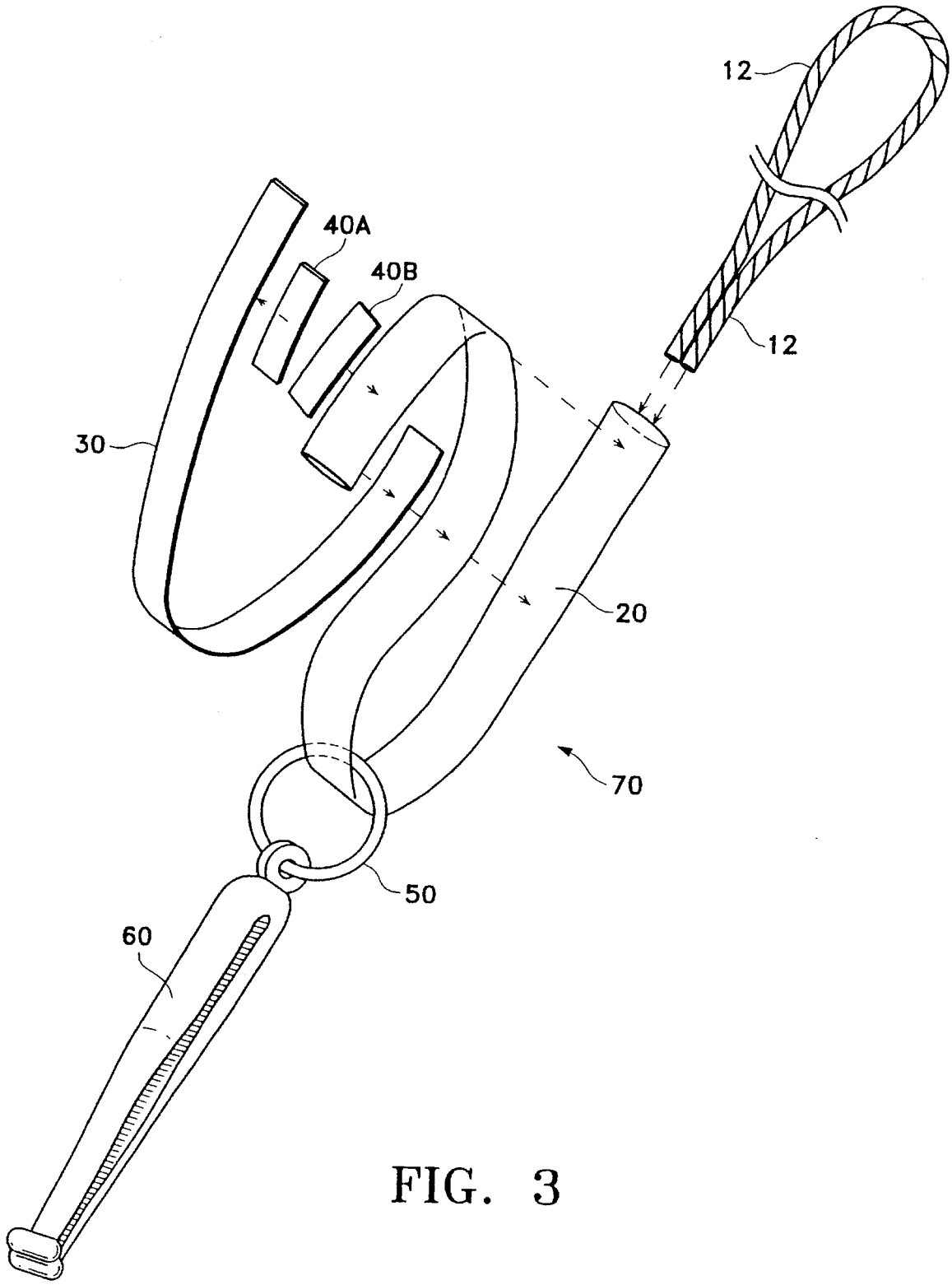
FIG. 3 shows an exploded view of the Mitt Clip body, the strap, and the clip.

An exploded view of the Mitt Clip model is illustrated in FIG. 3 (exploded view of Mitt Clip). The assembly time can be minimized by attaching the key ring 50 to the clip 60 in the first step. Then place the strap or cord's 12 doubled-up ends into the end of the body 20 a short distance. Take the opposite end of the body 20 and thread it through the key ring 50 then loop the end back to the strap or cord 12 end of the assembly so that the fold is approximately flush with the strap 12 end of the body 20. Leave enough of the body 20 to fold back once again toward the clip 60. The key strap 30 can then be slipped into the last fold of the body 20 a short distance. One side of the Velcro hook and loop fastener 40A or 40B, it does not matter which, can be placed on top of the last fold of the body 20. Then the body assembly 70 (FIG. 1B side view of Mitt Clip) can be permanently connected using any means that might work with the selected materials. Sewing is the method used for this embodiment. The last step is to attach the second half of the Velcro hook and loop fastener 40A or 40B, as appropriate, to the side of the key strap 30 that faces the body 20.

Figure 7A:
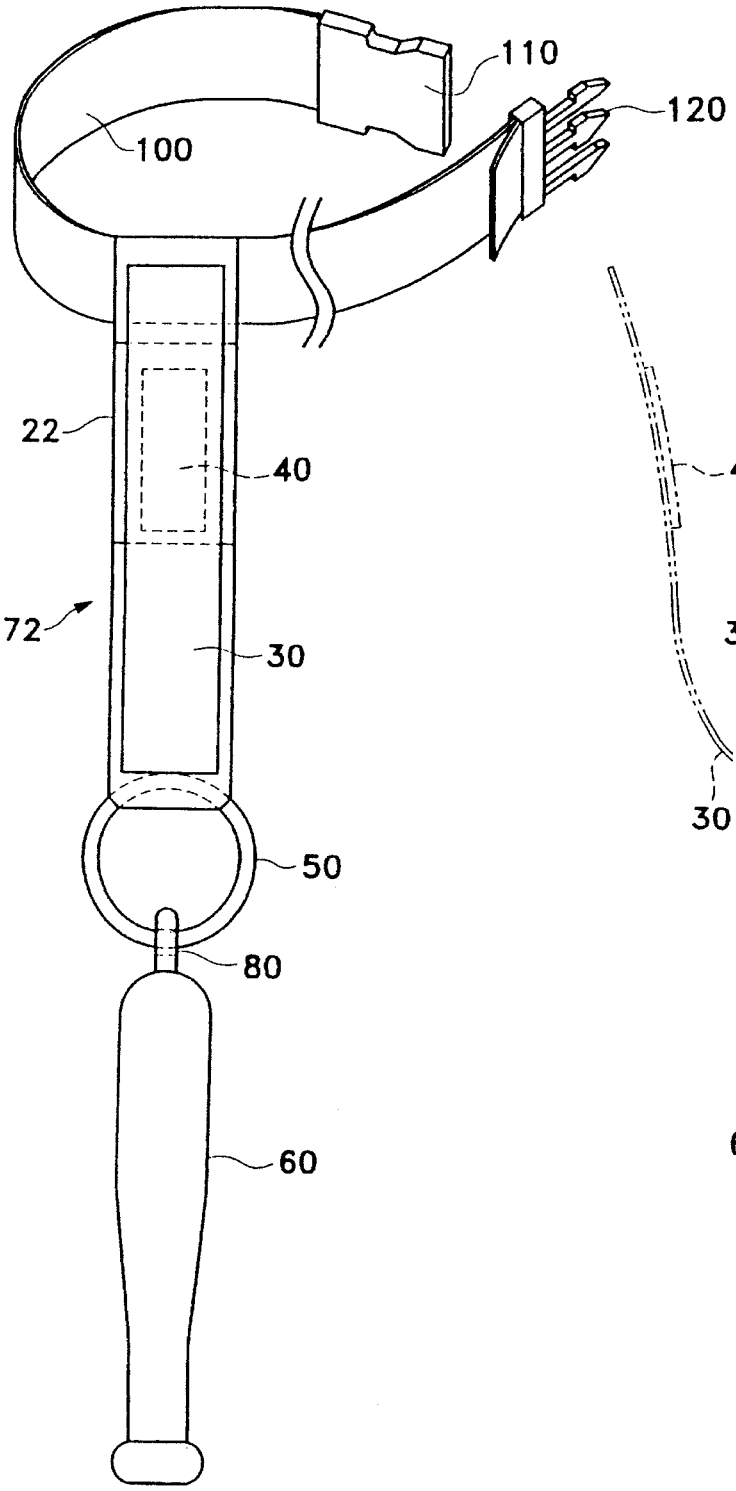
FIG. 7A shows a front view of the Mitt Manager body and clip with a three-dimensional perspective of the Mitt Manager strap and optional clip (fastex-type) assembly.
Figure 7B:
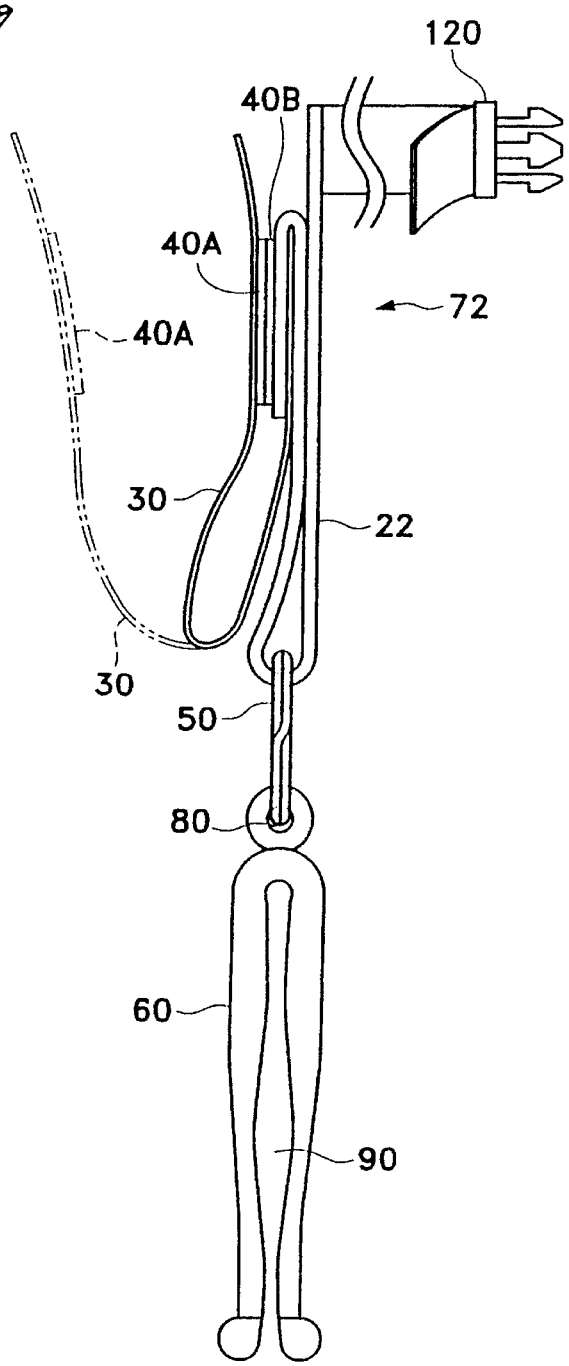
FIG. 7B shows a side view of the Mitt Manager.

One embodiment of the Mitt Manager model is illustrated in FIG. 7A (front view of Mitt Manager) and FIG. 7B (side view of the Mitt Manager). The body 72 in FIGS. 7A, 7B, and 8, appears nearly the same as the body 70 illustrated in previous drawings of the Mitt Clip embodiment; however, the difference is the amount of body material that extends beyond the last fold of the body 72. This additional material is needed to provide an attachment point for the strap 100 or strap 102, depending on which style may be manufactured. The strap illustrated in FIGS. 7A and 7B is assembled with the use of a (fastex type) of clip 110 and 120 for a means of attachment and adjustment. With the exception of these differences, the FIGS. 7A and 7B are the same.

Figure 8:
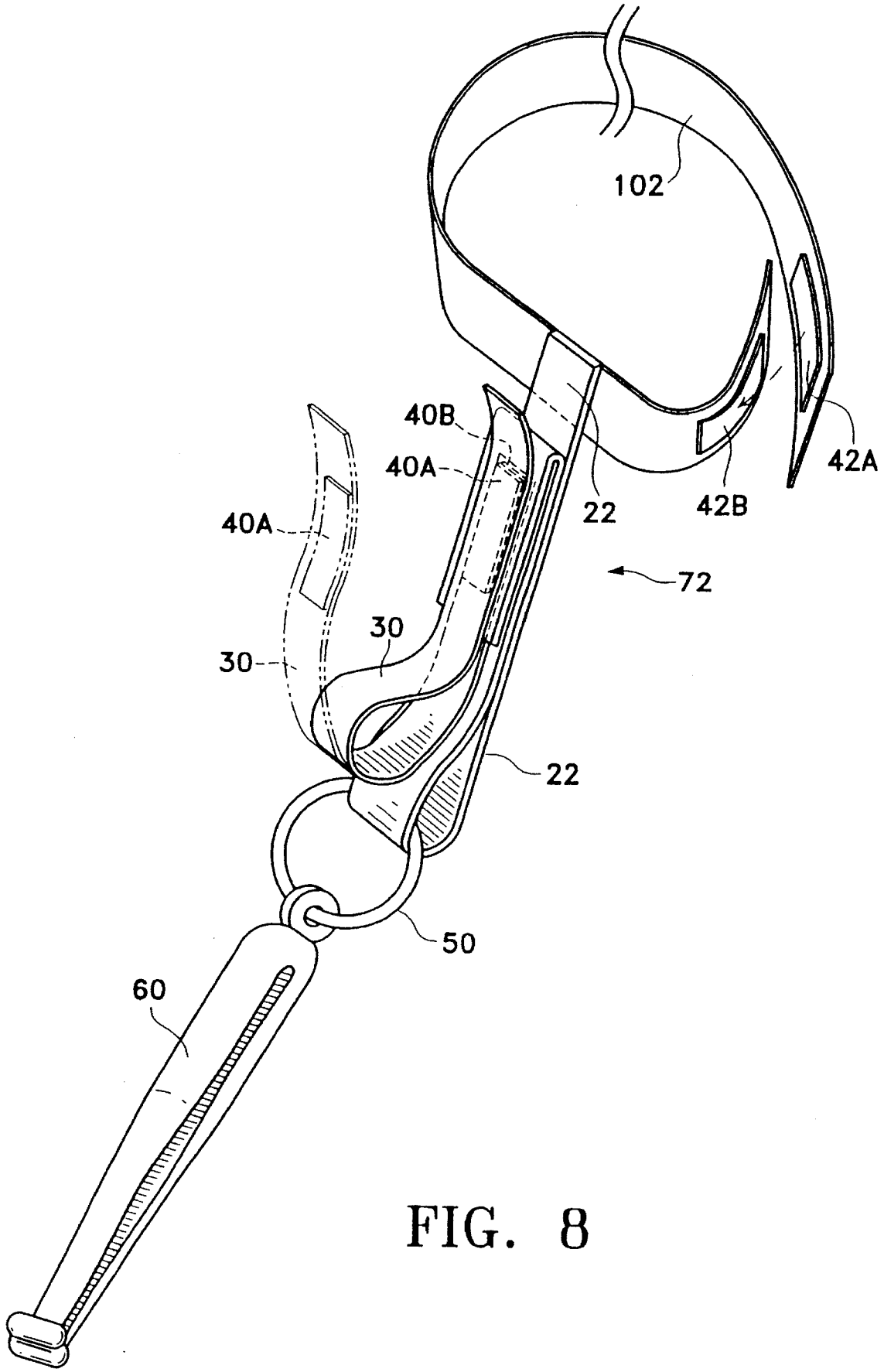
FIG. 8 shows a three-dimensional perspective of the Mitt Manager body, clip, and strap as it would appear if optional Velcro hook and loop fasteners were used in place of a clip (fastex-type) assembly as seen in FIG. 7A.

FIG. 8 (a three-Dimensional view of the Mitt Manager) illustrates the Mitt Manager which embodies yet another means of attachment and adjustment. The use of Velcro hook and loop fasteners 42A and 42B are illustrated on the strap 102. All other aspects of FIG. 8 (a Three-Dimensional view of the Mitt manager) are the same as in FIGS. 7A and 7B.

Figure 9:
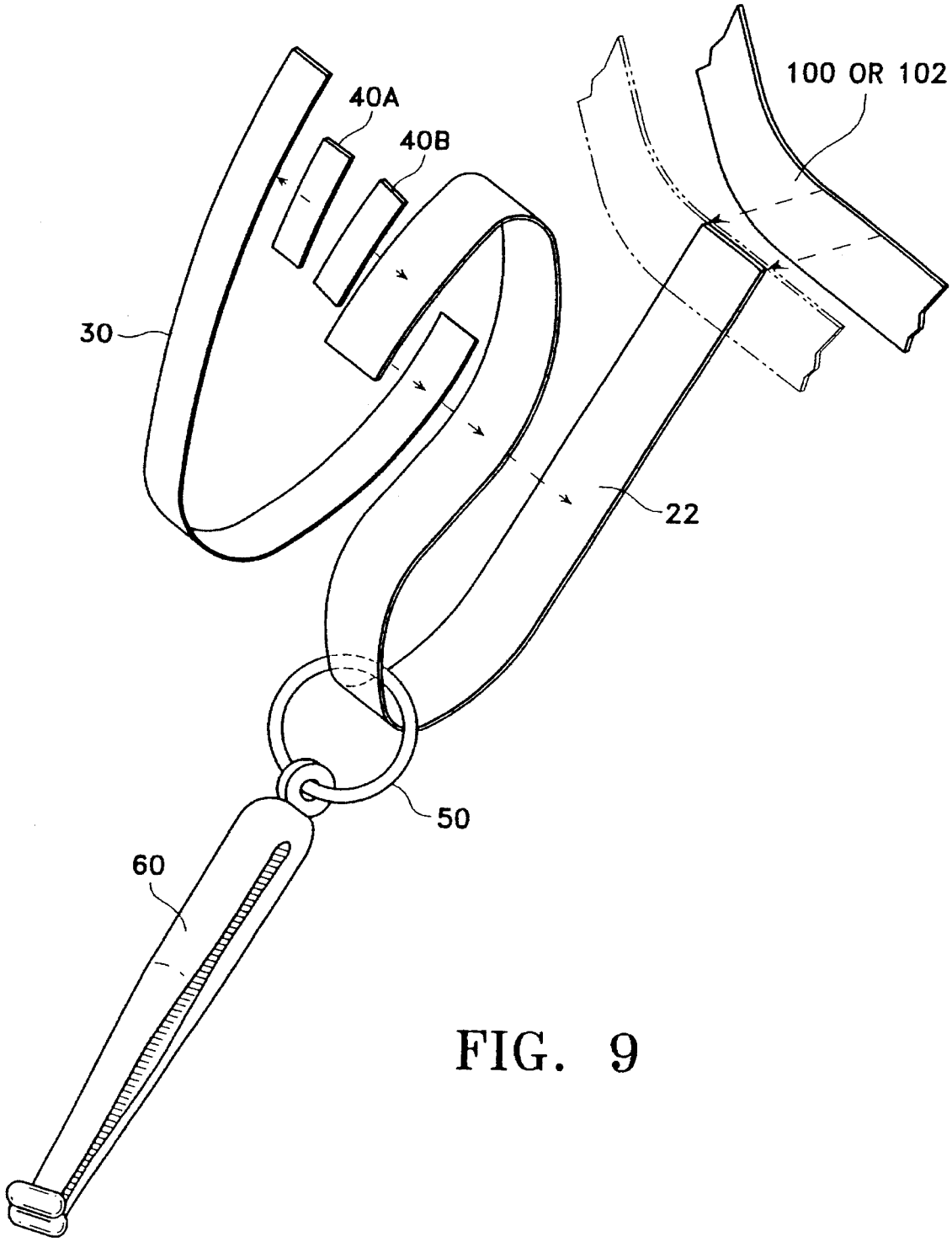
FIG. 9 shows an exploded perspective of the Mitt Manager with a portion of both strap options.

FIG. 9 (exploded view of the Mitt Manager) illustrates the body assembly 72 of the Mitt Manager with the strap 100 or 102 attachment shown. This strap 100 or 102 may be attached the same way the body assembly 72 is held together.

Figure 10A:
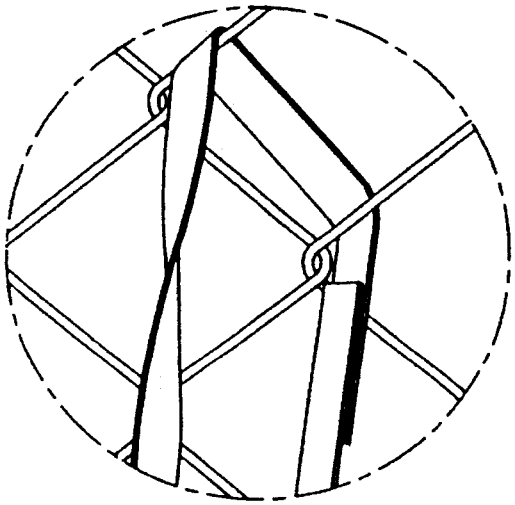
FIG. 10 shows the Mitt Manager attached to and suspended from a chain-link fence, with that portion of Velcro hook and loop fastener (optional) overlapped to secure the Mitt Manager to the fence.
Figure 10:
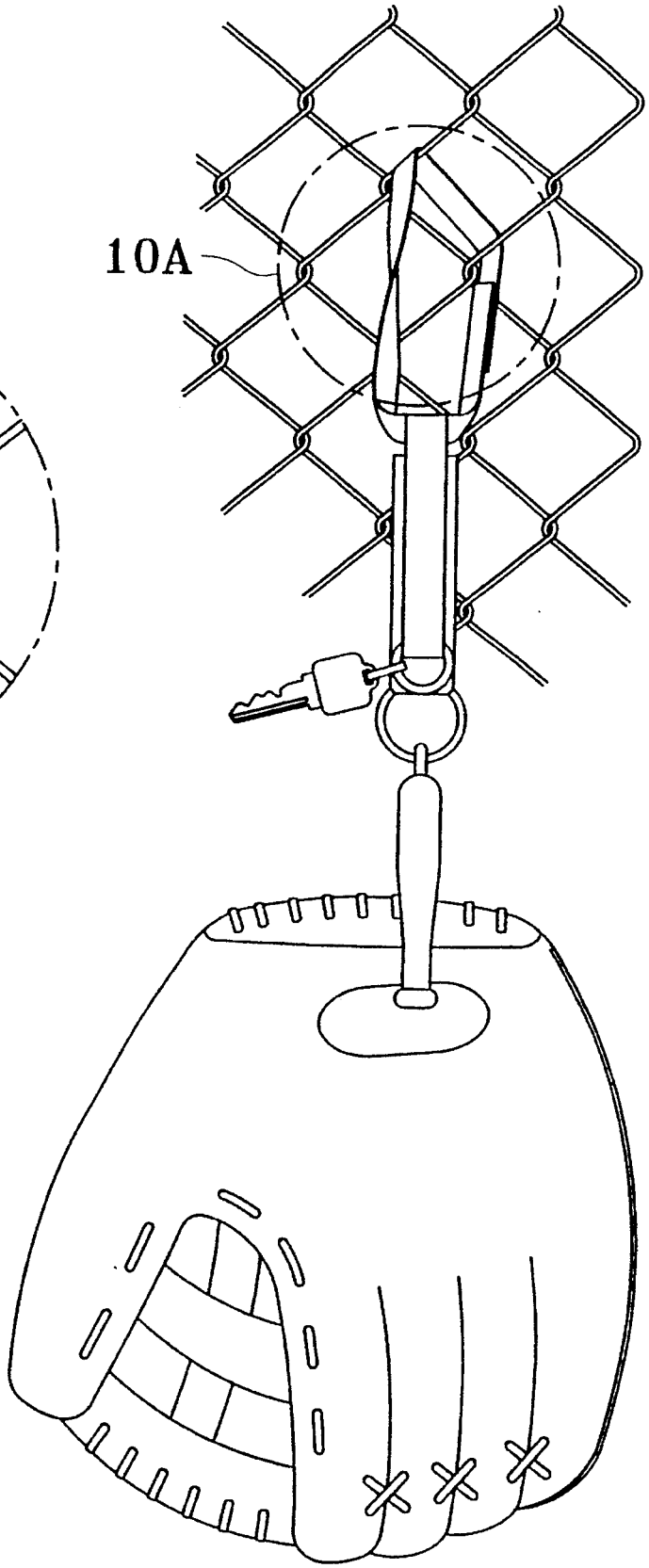

FIG. 10 (The Mitt Manager in use) shows the assembly secured to a chain-link fence with the use of Velcro hook and loop fasteners (FIG. 8 42A and 42B) on the strap (FIG. 8) 102, a key held by the key strap 30 and a ball glove being suspended and held by the clip 60.

Figure 11:
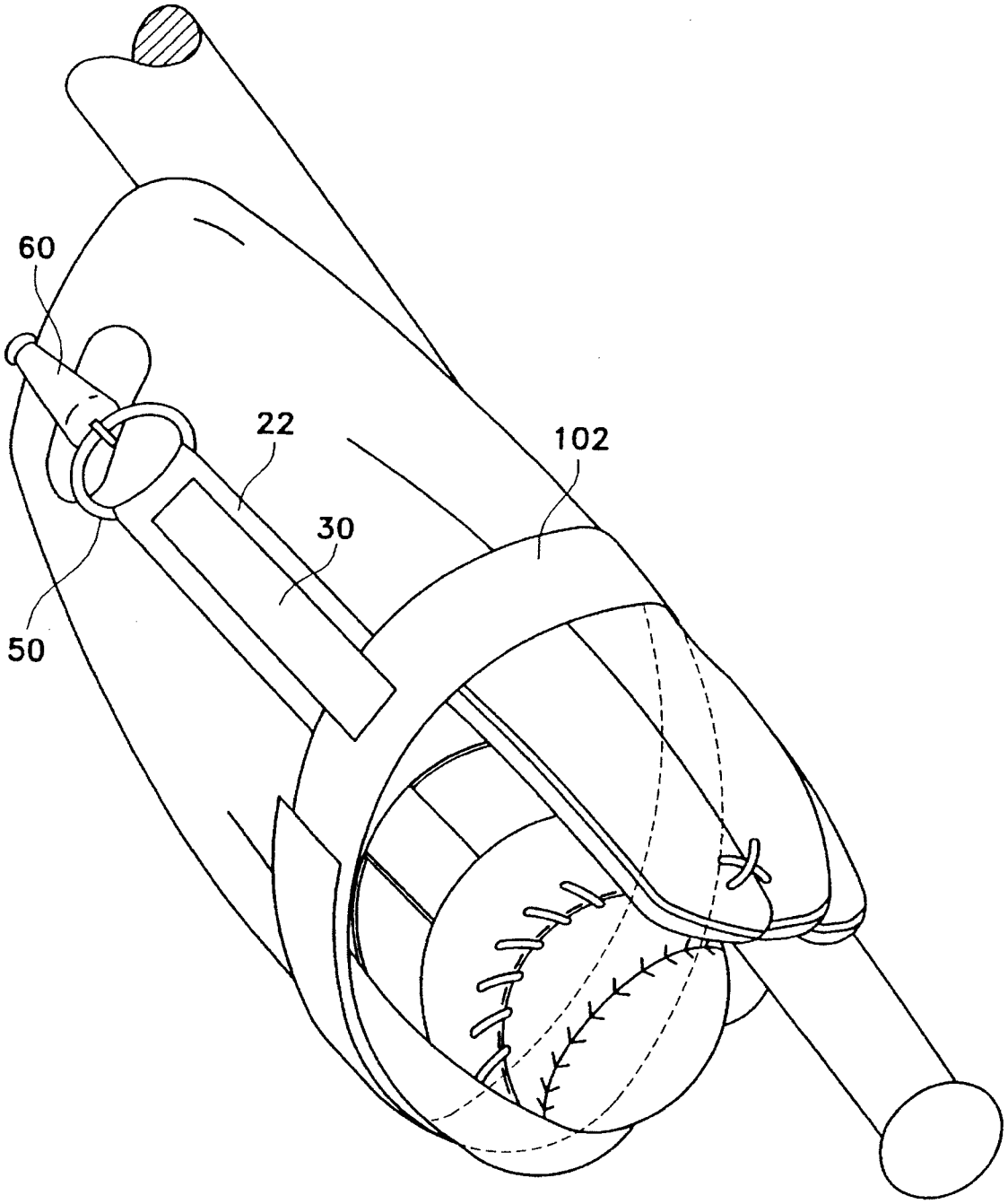
FIG. 11 shows the Mitt Manager used to store the mitt with a ball in the pocket, the clip placed over the mitt's wrist strap from the opposite direction as the other use, and the strap encompassing the mitt to secure the ball and hold the mitt's shape.

FIG. 11 (Mitt and ball stored with Mitt Manager) shows the Mitt Manager using the Velcro hook and loop fasteners ((FIG. 8. 42A and 42B) on the strap 102 as it would appear when a ball is in the pocket and the handle of a bat is encompassed with the strap 102. Additionally, a pair of batting gloves may be tucked into the pocket.

OPERATION—FIGS. 1A–11

The primary manner of using the Ball Glove Holding and Managing Device is illustrated to some extent in FIGS. 4, 5, 6, 10, and 11. The Mitt Clip embodiment is a basic version of the invention that can be secured to the fence of a dugout or any structure suited for attachment by the cord or strap 12 of the device. The loop of the cord or strap 12 (FIG. 2) is placed over a portion of wire and pulled down and around the wire far enough to allow the clip 60 (FIG. 2) and the rest of the device to be threaded through the loop of the strap 12 as illustrated in FIG. 5. The body assembly 70, key ring 50, and clip 60 are suspended from a fence in a manner as illustrated in FIGS. 4, 5 and 6. Other ways and means of providing an attachment to another structure are optional. For removal of the device, the procedure is reversed. This same function can be alternately used to hang the device and ball glove when not in use such as in a closet on a hook or nail for its storage. The key strap 30 provides a means of holding a small personal item such as a set of keys, watch or ring, during a ball game. The ball mitt is held and suspended by the clip 60. This is accomplished by taking the clip and sliding it over the hand end of the mitt's wrist strap or sliding the mitt's wrist strap up into the slit 90 of the clip 60. To remove the mitt from the device the mitt is simply pulled free from the mitt with one hand.

The use of the Mitt Manager embodiment is the same as the basic idea (Mitt Clip) but is broadened by the substitution of the cord or strap 12 (FIG. 2) with a strap 100 or 102 (FIGS. 7A, 8) that is adjustable, so as to provide a means of maintaining the shape of the ball mitt when being stored. This can be accomplished by placing a ball in the pocket and encompassing the pocket portion of the mitt with the strap 102 (FIG. 11) and sliding the clip 60 (FIG. 11) over the mitt's wrist strap from the opposite side (the ball end of the mitt) as is used to suspend and hold the mitt in the dugout during a game. Additionally, the Mitt Manager can hold a ball bat by using the strap 102 (FIG. 11) to encompass the handle of the bat while a ball is in the pocket of the mitt, thus maintaining the shape of the mitt during storage and managing the location of the ball, mitt, and the bat. A pair of batting gloves may even be tucked into the pocket.

CONCLUSION, RAMIFICATIONS, AND SCOPE

In conclusion, the "Ball Glove Holding and Managing Device" consists of a way to use a ball glove, care for it and manage its shape and location, as well as keep a ball, a bat, and a pair of batting gloves together in one place. Additionally, it provides a means for holding a small personal item, such as a set of car keys, during a ball game.

Although the descriptions, drawings, and details above contain numerous specificities, they are not intended to be construed as limiting in any way, the scope of the invention, but as simply illustrating some of the currently preferred embodiments of this invention. For example, the devices can be manufactured using any material, color or colors, shapes or designs, and may be assembled using any method or methods that will provide reasonable structural stability and durability for short- or long-term use that will facilitate its basic intended functions and any subsequently thought-of uses such as to manage a hockey mitt and puck.

Thus the scope of the enclosed invention should be outlined by the enclosed claims and their legal equivalents, as opposed to the examples depicted in this application.

I claim:

1. A device for temporarily attaching a ball glove to a support, said device comprising:

(a) a flexible cord shaped in the form of a loop and having a first end and a second end;

(b) a flexible strap body having:

(i) a first end having an opening that encloses said first and second ends of said flexible cord; and (ii) a second end looped back and attached to said strap body to form a second loop;

(c) a flexible key strap having:

(i) a first end attached to said flexible strap body; and (ii) a second end for releasably attaching to said flexible strap body and retaining an object;

(d) a first section of hook and loop fastener material attached to said first end of said flexible key strap;

(e) a second section of hook and loop fastener material attached to said second end of said flexible key strap for attaching said second end of said flexible key strap to said first end of said flexible key strap;

(f) a key ring interlocking said second loop formed by said flexible strap body;

(g) a clip for retaining said ball mitt having:

(i) a ring-shaped top interlocking said key ring;

(ii) a first prong extending away from said ring-shaped top having a proximate end, a mid-section and a distal end;

(iii) a second prong extending away from said circular top having a proximate end, a mid-section and a distal end and defining a slot with said first prong, said slot having:

(a) a tapered opening formed by said distal ends of said first and second prongs to allow insertion of said ball mitt;

(b) a narrow retaining section for retaining the wrist strap of said ball mitt, defined by said distal ends of said prongs;

(c) a mid-section for holding said wrist strap during storage, defined by said mid-sections of said prongs.

* * * * *